US006450330B1

(12) United States Patent
Cannata

(10) Patent No.: US 6,450,330 B1
(45) Date of Patent: Sep. 17, 2002

(54) APPARATUS FOR SUPPORTING TUBULAR SUBS DURING STORAGE AND TRANSPORT

(76) Inventor: A. J. Cannata, 7723 Hwy. 182 E., Morgan City, LA (US) 70381

( * ) Notice: Subject to any disclaimer, the term of this patent is extended or adjusted under 35 U.S.C. 154(b) by 0 days.

(21) Appl. No.: 09/850,813

(22) Filed: May 8, 2001

(51) Int. Cl.[7] ..... B65D 85/02
(52) U.S. Cl. ..... 206/303; 206/443; 211/70.4
(58) Field of Search ..... 206/379, 391, 206/394, 443, 446, 525, 363; 211/60.1, 69, 70.4

(56) References Cited

U.S. PATENT DOCUMENTS

| | | | | | |
|---|---|---|---|---|---|
| 1,341,848 | A | * | 6/1920 | Haensler | 211/69 |
| 1,732,480 | A | | 10/1929 | Lyon | |
| 2,258,960 | A | | 10/1941 | Rymal | 211/60 |
| 2,457,262 | A | * | 12/1948 | Norquist | 206/443 |
| 3,291,296 | A | | 12/1966 | Lemkelde | 206/16 |
| 3,690,609 | A | | 9/1972 | Montesdioca | 248/68 |
| 4,033,455 | A | * | 7/1977 | Robison | 206/391 |
| 4,445,579 | A | | 5/1984 | Bello | 175/52 |
| 4,573,585 | A | | 3/1986 | Frei | 211/13 |
| RE32,530 | E | * | 10/1987 | Cantey, Jr. | 206/391 |
| 4,725,179 | A | * | 2/1988 | Woolslayer et al. | 211/70.4 |
| 4,932,537 | A | | 6/1990 | Martinsen | 211/70.4 |
| 5,040,708 | A | * | 8/1991 | Blair et al. | 206/391 |
| 5,396,991 | A | | 3/1995 | Lachambre | 206/392 |
| 5,799,789 | A | | 9/1998 | Ritchie | 206/378 |

* cited by examiner

*Primary Examiner*—Jim Foster
(74) *Attorney, Agent, or Firm*—Garvey, Smith, Nehrbass & Doody, LLC; Gregory C. Smith

(57) ABSTRACT

A carrier for tubular members, such as subs, which includes a basket, having a floor portion and a plurality of side walls, and an open top portion; a plurality of holes formed in the floor of the basket, of equal diameters; a plurality of pins insertable in the plurality of holes, the pins extending upward into the basket opening substantially to the height of the basket walls; each of the pins having a base portion of equal diameters to slidably engage into any bore on the floor portion, and an upper elongated body portion of differing diameters to slide within a bore of a tubular sub, so that the sub may be supported in a vertical position on the pins, and not make contact with other subs supported vertically on the other pins in the basket while the subs are being stored or transported.

13 Claims, 3 Drawing Sheets

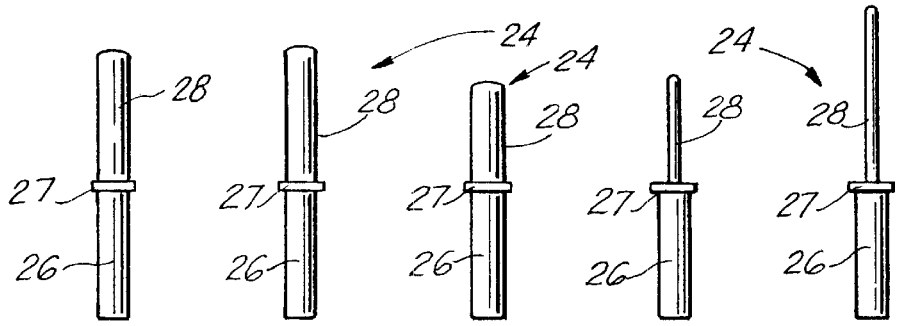
FIG. 4A FIG. 4B FIG. 4C FIG. 4D FIG. 4E
FIG. 5
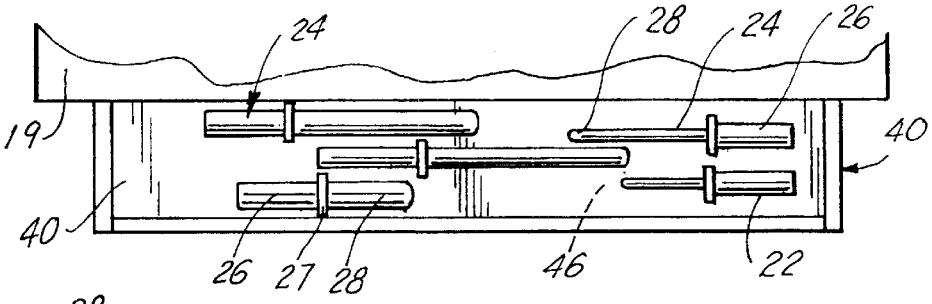
FIG. 6
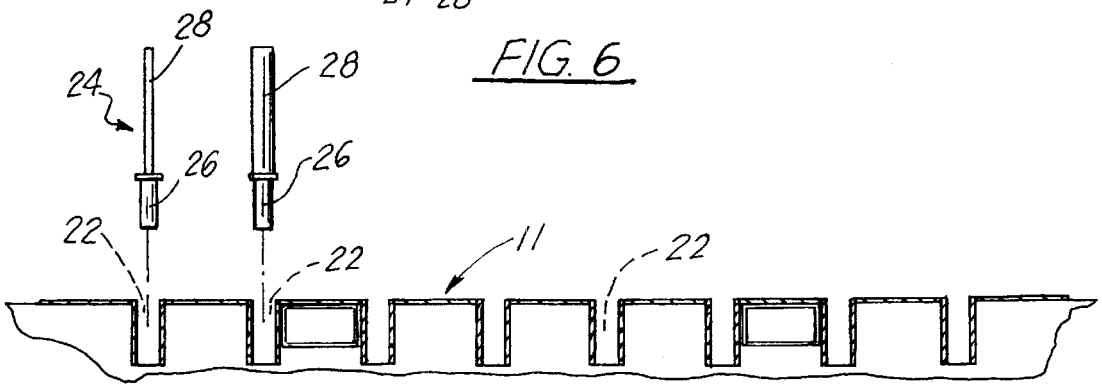

APPARATUS FOR SUPPORTING TUBULAR SUBS DURING STORAGE AND TRANSPORT

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to short tubular members, such as subs or downhole stabilizers in the oil field. More particularly, the present invention relates to a basket for supporting subs or stabilizers on individual pins in a vertical position to prevent the subs from shifting during storage at or transport to a site.

2. General Background of the Invention

In the drilling and completion of oil or gas wells, the drill or production string is made up of a plurality of tubular members threadably engaged end to end to define the string. Very often, short segments of pipe, which are known in the industry as "subs" are utilized to undertake a certain task, as in directional drilling, or in certain downhole procedures. These subs are usually circular in cross-section, having a bore therethrough, and are of various diameters. Some subs may be in the form of stabilizers, which are subs having wings radiating out from the wall so that the wings make contact with the casing to maintain the string in a central stabilized position downhole. Normally the various types of subs are three to five feet in length, and are transported to and from the rig site as the case may be. Since these subs are normally fabricated from iron or steel, despite their short length, they are quite heavy; and because of their tubular design, unless they are tied down, they have a propensity to roll around on the floor of a boat or basket, which may be detrimental to the sub, or worse yet, may injure a person who is riding in the boat, as the sub rolls across the floor and contacts the person's foot or leg.

Therefore, there is a need in the industry for an apparatus which would enable such subs, of various lengths and diameters, to be transported in a manner in which the subs can be stable during transport, or while it is being stored, can be easily accessed when the sub has reached its destination.

BRIEF SUMMARY OF THE INVENTION

The apparatus of the present invention solves the problems in the art in a simple and straightforward manner. What is provided is a carrier for tubular members, such as subs, which includes a basket, having a floor portion and a plurality of side walls, and an open top portion; a plurality of holes formed in the floor of the basket, of equal diameters; a plurality of pins insertable in the plurality of holes, the pins extending upward into the basket opening substantially to the height of the basket walls; each of the pins having a base portion of equal diameters to slidably engage into any bore on the floor portion, and each sub having an upper elongated body portion of differing diameters to slide within a bore of a tubular sub, so that the sub may be supported in a vertical position on the pins, and not make contact with other subs supported vertically on the other pins in the basket.

Therefore, it is a principal object of the present invention to provide an apparatus for transporting subs in a vertical fashion, so that the subs do not move around and make contact with one another or other objects;

It is a further object of the present invention to provide a basket, having a plurality of bores to accommodate a plurality of various diameter pins, the diameter of the pins supporting subs of like bore diameters so that the subs may be easily positioned onto each of the pins for transport and easily slidably removed from the pins after transport is completed and the subs are being stored;

It is a further object of the present invention to provide a basket whereby a plurality of pins each having a base portion of equal diameters so that the base can be inserted into any of a plurality of bores in the floor of the basket, and each pin having a body portion of different diameters depending on the diameter of the sub to be positioned thereon;

It is a further object of the present invention to provide a storage container with the basket for storing unused pins.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIGS. 4A–4E illustrate views of various sizes of support pegs utilized in the apparatus of the present invention;

FIG. 5 illustrates a view of the peg storage basket of the apparatus of the present invention; and FIG. 6 illustrates a side cutaway view of the floor portion of the preferred embodiment of the apparatus of the present invention.

DETAILED DESCRIPTION OF THE INVENTION

Figure 1:
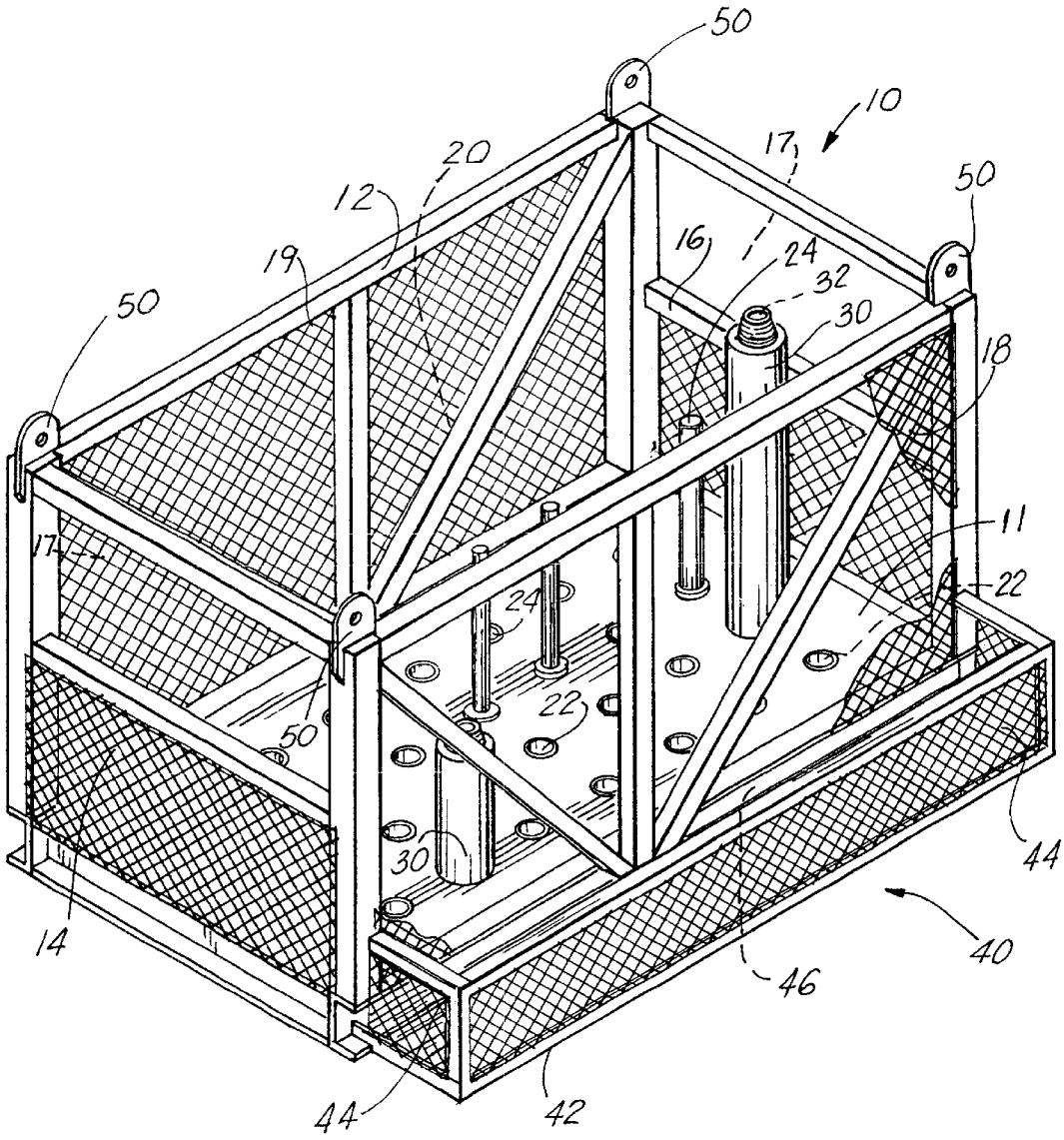
FIG. 1 illustrates an overall perspective view of the preferred embodiment of the apparatus of the present invention.

FIGS. 1 through 6 illustrate the preferred embodiment of the present invention by the numeral 10. As seen in overall view in FIG. 1, transport apparatus 10 comprises a generally rectangular floor portion 11, with four upright wall portions 12, 14, 16, 18, defining a basket 19 having a container space 20 therein. The walls would include an upper support member 23 for increasing the stability and strength of the walls 12, 14, 16, 18. Likewise each of the end walls 14, 16 would include an opening 17 along their upper portion for allowing easy access into the container space 20.

Figure 2:
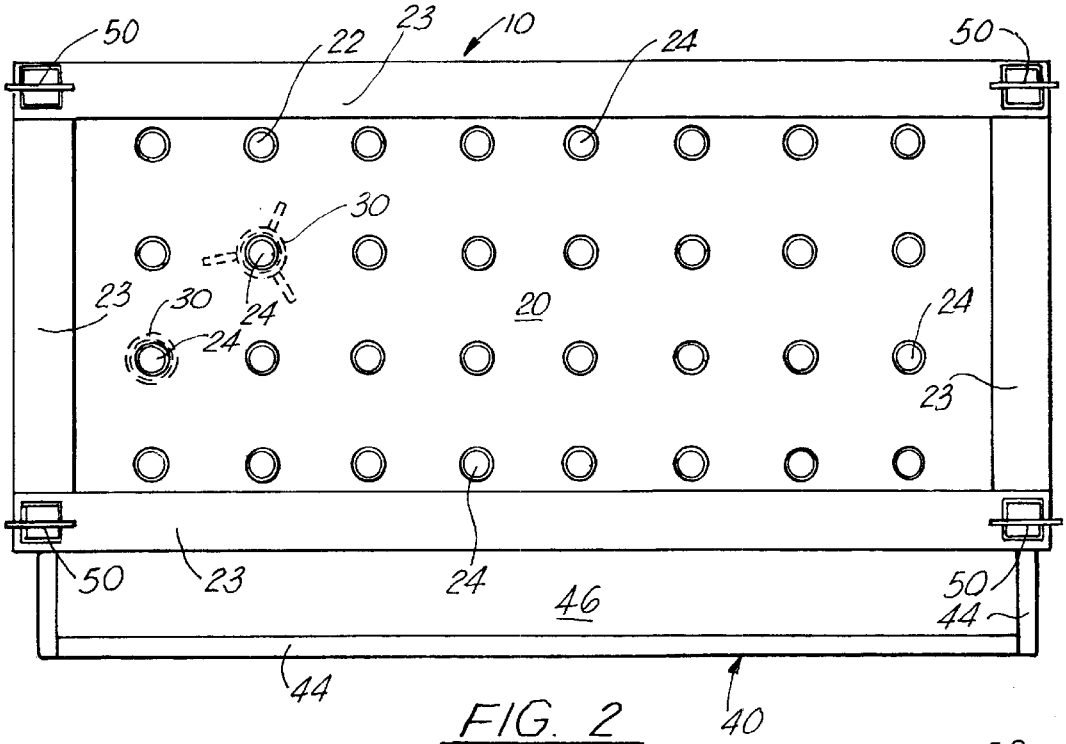
FIG. 2 illustrates a top view of the preferred embodiment of the apparatus of the present invention.
Figure 3:
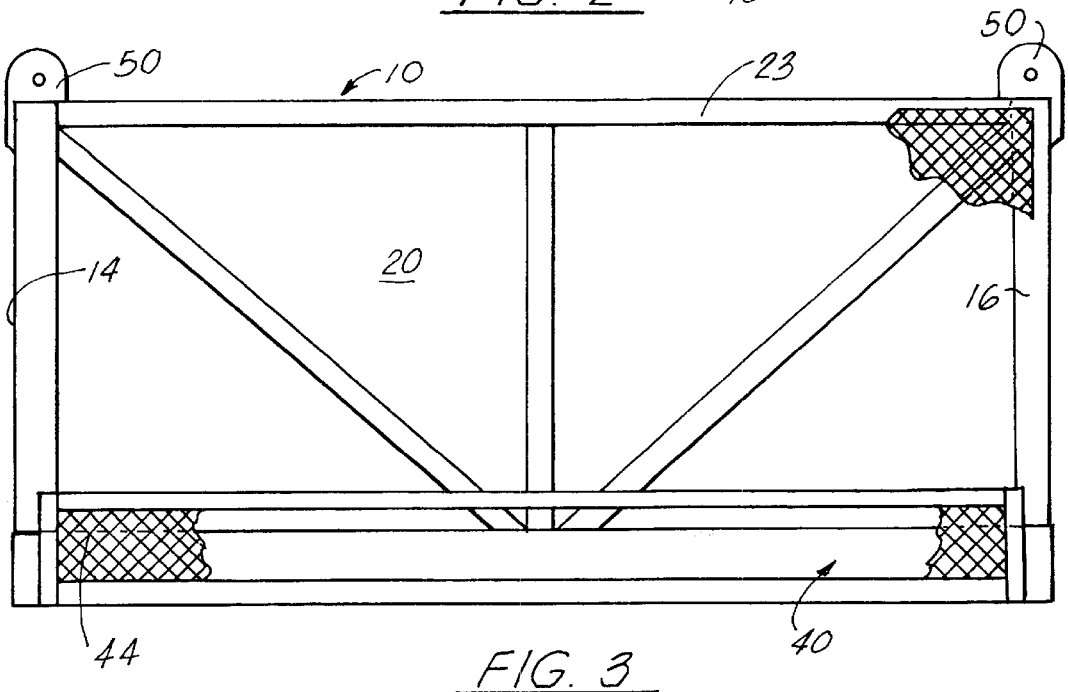
FIG. 3 illustrates a side view of the preferred embodiment of the apparatus of the present invention.

The floor portion 11 would be fabricated of steel or the like material, and include a plurality of bores 22 through the floor 11. Each of the bores 22 would be of equal diameter, and would be spaced throughout the floor portion 11, to support a plurality of pins 24, as seen in FIG. 2, for the reasons to be provided herein. There would be further provided a plurality of pin members 24, each of the pin members comprising a lower base portion 26, of the same diameter as the bores 22 in the floor 11 so that the base of any pin member 24 could be engaged into any of the bores 22.

As seen in FIGS. 4A–4E, each pin member 24 would also include an upper elongated body portion 28 extending from the base portion 26, to varying heights, depending on the length of sub to be supported thereon, but generally equal to or below the height of the various wall portions 12, 14, 16, 18. Although the base portions 26 are of equal diameter, the upper body portions 28 of the pins 24 would be of varying diameters and heights, again depending on the size of the sub or stabilizer to be supported, as will be explained further. There would be provided a shoulder 17, separating the upper portion 28 from the base portion 26, so as to allow the pin to be positioned in a bore 22, only to a certain depth.

As seen in FIG. 1, the transport apparatus 10 is illustrated supporting a "sub" or "stabilizer" of the type used in oil and gas well drilling and completion. A sub 30 could be defined as a shortened piece of pipe, threadably secured within a drill string, which allows for certain functions downhole. As seen in FIG. 1, subs come in varying lengths and inner bore diameters, depending on the size of the drill or completion string to which it is secured. A stabilizer 30 is very similar-in construction to a sub, likewise having varying inner bore diameters. The difference is that most stabilizers include a plurality of fins spaced around the outer wall which serve to maintain the stabilizer centrally positioned within the borehole, and thus, other tools centrally positioned. A sub 30 and stabilizer 31 are illustrated in FIG. 2 in phantom view supported in a pin 24 within basket 19.

Reference is now made to again to FIG. 1 which illustrates the manner in which the apparatus is used. As illustrated, the basket portion 19 has positioned therein a plurality of pins 24 secured within the bores 22 of floor 11. The diameter of the pins 24 are determined by the inner diameter of the sub or stabilizer which it will support. For example, in FIG. 1, a pin 24 of a certain diameter is supporting a sub, designated as 30, in a vertical manner, as the pin 24 is engaged within the bore 32 of the sub 30. Because the pin diameter is slightly less than the diameter of bore 32 of sub 30, the sub 30 is held vertically secure and is unable to move as the apparatus 10 is being used to transport the subs on a boat or truck.

As seen in top view in FIG. 2, the placement of the pins 24 in the various bores 22, allow sufficient space between each pin 24, so that when a sub or stabilizer 30 is placed thereupon, there is no physical contact between any of the subs or stabilizers 30 once they are vertically positioned on the various pins 24. This provides a safe and secure transport of these tools (subs and stabilizers), without fear that the tools will roll freely around the basket 19 during transport or storage, which will avoid damage to the tools, and more important, avoid the heavy iron subs or stabilizers from making contact with a person in the basket, which could result in serious injury. Of course when the transport is complete, the tools are slidably removed from each of the pins 24, and the pins may themselves be removed from the basket 19.

Since it is foreseen that pins 24 may have to be interchanged, for example, when other subs have to be placed in the basket 19 to be returned from a rig site, there is further provided a storage basket 40, seen in overall view in FIG. 1, and in top view in FIG. 6, which in the preferred embodiment, would secured to one of the long walls, 14, 18, and would itself have a floor portion 42, and walls 44, defining a storage space 46 therein. The pins, when not in use, could be laid within the space 46 of storage basket 40 until the pins would be needed for use in the transport basket 19.

Also, basket 19 would be provided with eyelets 50 positioned at each upper corner of basket 19, and secured to the basket 19. When basket 19 needs to be lifted, particularly when it is loaded with subs or stabilizers 30, cables could be secured within eyelets 50, and basket 19 could be lifted via a crane or the like onto a boat for transport to a rig site, and could be off-lifted from the boat.

Although the apparatus 10 as described herein is particularly designed to transport subs and stabilizers, it is foreseen that the apparatus could transport any type of tool which would have a bore which could be engaged by one of the pins 24 so as to maintain the tool or device secure without having the ability to move about the basket 19 during transport.

The foregoing embodiments are presented by way of example only; the scope of the present invention is to be limited only by the following claims.

What is claimed is:

1. An apparatus for transporting and storing tubular sub members of the type having a tubular body with a bore therethrough, the apparatus comprising;

a a floor portion, having a plurality of spaced apart bores therein;

b a plurality of walls surrounding the floor portion and defining a transport space therein;

c removable pins, each pin insertable into a bore in the floor portion for supporting the pin upright;

d a sub slidably engaged on the pin members, so that a sub engaged on a pin does not make contact with a sub on an adjacent pin while the subs are being transported and stored.

2. The apparatus in claim 1 wherein the basket further comprises a means for lifting the basket onto a boat or other transport vehicle.

3. The apparatus in claim 1, wherein each of the bores in the floor portion are of equal diameter.

4. The apparatus in claim 1, wherein each of the pins further comprise a base portion of equal diameters for being insertable into any of the plurality of bores in the floor portion.

5. The apparatus in claim 1, wherein the pins further comprise an elongated body portion extending from the base portion for insertion into the bore of a sub thereupon, the elongated body portion being of differing diameters depending on the size of the bore of the sub to be supported thereupon.

6. The apparatus in claim 1, wherein the pins are removable from the floor portion, and interchangeable with pins of differing body diameters.

7. The apparatus in claim 1, further comprising a storage container portion for storing additional pins.

8. An apparatus for use in combination with tubular subs of the type having a tubular body with a bore therethrough, the apparatus comprising;

a. a floor portion, having a plurality of spaced apart bores of equal diameters therein;

b. a plurality of walls surrounding the floor portion for defining a storage basket;

c. removable pins, each pin having a base portion insertable into any of the bores in the floor portion for supporting the pin upright;

d. the tubular sub having a particular bore diameter slidably engagable on a pin member capable of being inserted into said sub bore, so that the sub supported vertically on the pin is maintained stable during transport and storage.

9. The apparatus in claim 8, wherein the pins are removable from the floor portion, and interchangeable with pins of differing body diameters.

10. The apparatus in claim 8, wherein the basket further comprises a storage container portion for storing additional pins.

11. An apparatus for use in combination with tubular subs, of the type having a tubular body with a bore therethrough, the apparatus comprising;

a. a floor portion, having a plurality of spaced apart bores of equal diameters therein;

b. a plurality of walls surrounding the floor portion, and defining a transport basket;

c. removable pins, having base portions of equal diameters insertable into any of the bores in the floor portion for supporting the pin upright and upper elongated body portions of differing diameters;

d. the tubular sub member having a particular bore diameter slidably engaged on a pin member body portion of a diameter capable of being inserted into said sub member bore, so that the sub member supported vertically on the pin is maintained stable during transport or storage.

12. The apparatus in claim 11, wherein the basket further comprises a means for lifting the basket onto a boat or other transport vehicle.

13. The apparatus in claim 11, wherein the sub member further comprises a stabilizer.

* * * * *